US006640516B1

(12) United States Patent
Thompson

(10) Patent No.: US 6,640,516 B1
(45) Date of Patent: Nov. 4, 2003

(54) SHEATHING TIE DOWN

(76) Inventor: Thomas C. Thompson, 92-543 Kokole Pl., Makakilo, HI (US) 96707

( * ) Notice: Subject to any disclaimer, the term of this patent is extended or adjusted under 35 U.S.C. 154(b) by 0 days.

(21) Appl. No.: 09/945,283

(22) Filed: Sep. 1, 2001

Related U.S. Application Data

(63) Continuation-in-part of application No. 09/389,677, filed on Sep. 2, 1999, now Pat. No. 6,415,575.

(51) Int. Cl.[7] ..... E04B 1/38
(52) U.S. Cl. ..... 52/712; 52/714; 52/715
(58) Field of Search ..... 52/712, 714, 715, 52/514

(56) References Cited

U.S. PATENT DOCUMENTS 4,976,085 A * 12/1990 Krueger ..... 52/715
5,653,079 A * 8/1997 Loeffler et al. ..... 51/712
6,009,681 A * 1/2000 Kozloff ..... 52/712
6,094,880 A * 8/2000 Thompson ..... 52/712
6,101,780 A * 8/2000 Kreidt ..... 52/712
6,209,277 B1 * 4/2001 DiGate ..... 52/514
6,295,781 B1 * 10/2001 Thompson ..... 52/712
6,415,575 B1 * 7/2002 Thompson ..... 52/712

* cited by examiner

*Primary Examiner*—Jeanette Chapman

(57) ABSTRACT

An improved metal connector that securely ties together sheathing and underlying structural members on a building to prevent hurricane and earthquake damage. The connector has alternating sheathing tabs for securing multiple sheets of sheathing. Connected underneath the sheathing tabs, a rib separates the sheathing and correctly spaces each adjoining sheet with a slight gap to avoid buckling. Below the rib, rafter webs alternate with the sheathing tabs to prevent movement of the sheathing and rafter. The large surface area and precise nail holes on the sheathing tabs avoid sheathing splitting and assures correct attachment to the underlying structural member.

19 Claims, 10 Drawing Sheets

SHEATHING TIE DOWN

This is a Continuation-in-Part of application Ser. No. 09/389,677 filed on Sep. 2, 1999, now U.S. Pat. No. 6,415,575 and relates to a connector that positively holds sheathing to underlying structural members, creating buildings that are resistant to earthquakes, hurricanes, and tornadoes.

BACKGROUND—FIELD OF INVENTION

DESCRIPTION OF PRIOR ART

On the windward-side of hurricane-force winds, wind pressure creates tremendous force on the wall of a building. The house can be pushed off the foundation by wind pressure. On the leeward-side of hurricane-force winds, negative pressure can bow out the wall and detach it from the building.

Adjacent walls can tilt or rack when the windward and leeward walls are being pushed and pulled. Wall sheathing helps prevent the wall from racking, or tilting. Sheathing that is tightly secured to the walls, helps transfer lateral forces to the foundation.

Earthquakes generate lateral movements on the walls, causing them to rack or twist off the foundation. If the wall sheathing fails by being pushed in, pulled out, or rocked laterally, the walls can collapse because they can not stand when weakened and supporting the heavy load of the roof.

Failure of the wall sheathing is common during strong winds and seismic movements, mainly because of inadequate fastening of the wall sheathing to the underlying structural members. Sheet metal joints perform better than nailed joints in high winds and during seismic activity.

Hurricanes

Studies of damage after Hurricane Andrew show several problems with the attachment of wall sheathing that this invention solves. Some sheets of wall sheathing that were blown off houses had staples or nails that had rusted away, and on some sheets the nails had just pulled out from the studs.

The engineering staff of the American Plywood Association provided technical personnel to assess the damage from Hurricane Andrew in Florida. The majority of wood structural sheathing failures were attributed to improper connection details, and in every case investigated, the sheathing loss was a result of improper nailing (Keith, 1992). These problems have not been solved because staples and inadequate nailing schedules are still used to tie down sheathing.

Earthquakes

During an earthquake, the floor, wall, and roof diaphragms undergo shearing and bending. The shear forces from the roof boundary members are transferred to the top of the shear wall by way of toenails or blocking to the top plate. To withstand and transfer the shear loads, plywood sheets have to be spliced together to prevent adjoining edges from sliding past or over each other (Gray, 1990).

Butted together on the centerline of a 2×(nominally 1½-inches-wide), you've only got ¾ inch bearing for each plywood sheet, so the nail has to be ⅜ inch from the edge. This leaves little margin for error, and nailing has to be done with care to avoid splitting the plywood and missing or splitting the underlying member (Gray, 1990).

Tests at the University of California show that plywood secured by overdriven nails, nails that penetrated the plywood beyond the first veneer (usually by a powered nailgun), failed suddenly and at loads far below those carried by correctly nailed plywood panels (Gray, 1990).

Steel connectors, between different components of a wood-frame building's superstructure, provide continuity so that the building will move as a unit in response to seismic activity (Yanev, 1974).

PRIOR ART

A number of connectors have been developed to tie together the structural members of a house under construction. Up until this invention, nobody had seen how to make a compact connector that could tie two or more sheathing sheets together and to the underlying structural members of the stud and sill plate.

Some prior art prevents uplift, but this invention not only prevents uplift between the stud and sill plate during hurricane-force winds, but prevents lateral movement during earthquakes.

The Simpson Strong-Tie Co.'s January 2000 catalog (page 37) lists a PSCL Plywood Sheathing Clip. This clip provides a gap and aligns sheathing but does not tie the sheathing to underlying structural members or prevent uplift or lateral movement. No other sheathing ties were found in their catalog, but they do show several mudsill connectors (pages 10–13) that tie the sill plate or stud to the concrete foundation.

The Simpson catalog also shows a Strong-Wall™ Shear wall (pages 14–17). This complicated system ties the wall stud and sill plate to the foundation, and includes the sheathing. It appears that the Shear wall is purchased and installed as a complete system.

The Simpson catalog also shows hold-downs (pages 19–22) that use bolts imbedded in the foundation concrete to hold down a sill plate. Their other hold-downs (pages 23–25) must be inserted into wet concrete. None of the above hold down sheathing that is installed on site.

Timmerman's U.S. Pat. Nos. 6,244,004 and 6,158,184 are Lateral Force Resisting Systems, but they do not tie down the wall sheathing.

Leek's U.S. Pat. No. 5,732,519 is a one-piece foundation-to-frame connection, but it too does not tie down the wall sheathing. In order to form the wall into a shear-wall, the wall sheathing must be held tightly to the wall stud and sill plate.

A prior art roof securing system by Llorens, U.S. Pat. No. 5,390,460 ties down a single sheet of roof sheathing to a support beam. This is a good connector, but it is long, and can only tie down one-size of sheathing. It must be hammered around the beam from below, but panels are installed from above the roof. Although Llorens' 460 could be used on a wall, it can only tie down one panel and provides little lateral support.

Another sheathing strap and alignment guide by Nellessen, U.S. Pat. No. 5,423,156 shows an apparatus for securing sheathing using a long strap, connecting bands, and saddles. This is a good connector, but it is long, complicated, and must be installed from below the roof. With sheathing in place, this is difficult. Although Nellessen's 156 could be used on a wall, it can only tie down panels of one size.

According to the magazine Fine Homebuilding, October/November, 1998, sheathing courses should begin with either a full or half sheet. The course of sheathing at the top row and beginning row are often odd-size, in order to get a reasonable width of sheathing on the top row (by the top plate).

OBJECTS AND ADVANTAGES

Accordingly, several objects and advantages of my invention are that it helps secure the sheathing on the roof and wall, to keep the building from being destroyed by hurricanes, tornadoes, and earthquakes.

This invention helps prevent the wall of a building from detaching from the wall studs during a hurricane or earthquake. It makes the wall into a stable shearwall, transferring shear forces into the foundation and ground.

This invention helps prevent the roof of a building from detaching from the rafters or roof trusses during a hurricane. It ties the roof sheathing securely to the underlying rafter or roof trusses, transferring lateral and uplift forces to the walls and to the foundation.

This invention helps prevent the floor of a building from detaching from the floor joists during an earthquake. It makes the floor into a horizontal shear wall, and helps the floor resist lateral forces in its horizontal plane. It also makes sure that any forces transferred from the roof and wall can be managed by the floor and transferred properly to the ground.

One object of this invention is to make each sheathing structure on a house into a shear-wall, that is, able to transfer forces without breaking or disconnecting. By tying the plywood securely to the underlying structural member, the plywood can reliably transfer and dissipate shear, lateral, and uplift forces to the ground.

During an earthquake or a hurricane, another object is for the building with my invention to move as a sturdy unit, resisting and transferring destructive forces to the ground. Mounted on the roof sheathing and rafter, my invention resists uplift, the most destructive force during a hurricane. Mounted on the wall stud and wall sheathing, my invention prevents the wall sheathing from being blown off or sucked out by the extreme negative pressure of a hurricane. Mounted on the floor sheathing and floor joists, my invention prevents the floor from separating, if it should get wet during a hurricane.

During an earthquake, when my invention is mounted on the roof, walls, and floors, they will turn each member into a shear wall. The secured plywood will absorb and dissipate earth movements, without becoming detached from the underlying structural members. It will also prevent the sheathing from sliding over or past each other.

This could improve a house to existing building codes, as sheet metal joints have been proven to perform better than nailed joints during hurricanes and earthquakes.

Another object of this invention is the large surface area on the top or outside part of the sheathing. This area prevents the plywood sheathing from splitting during nailing. The large surface area provides more strength in the hold-down process.

Still another advantage is the accurately placed nail holes on the invention. These nail holes prevent nails from splitting the plywood or underlying rafter, stud, or joist, by making the framer place nails at the correct and accurate location.

Another advantage is that the invention prevents overdriven nails from penetrating the fragile outer veneer of the plywood sheathing. The accurately placed nail holes prevent the nailhead from piercing the outer veneer of the plywood.

Another advantage is that some nails, on the invention, are driven into the strong broad side of a rafter, stud, or joist, forming a very strong connection to the sheathing, preventing the nails from pulling out.

Yet another advantage of this invention is during earthquakes, nails can sometimes bend with the movements of the house, but screws often break. Even though screws hold tighter than nails and provide a tight connection against uplifting forces from hurricanes, they are less resistant against earth movements. This invention absorbs and transmits most of the forces during an earthquake and hurricane so nails and/or screws can be used as fasteners.

Another advantage is that since the invention absorbs and transfers earthquake and hurricane forces, less nails and nailing could be used. Also, screws could be used in the invention in earthquake areas with less fear that the heads will shear off.

Still another advantage of the invention is in the ability to prevent plywood sheets from sliding past or over each other during an earthquake. Previously, only nails had to shear, but this entire connector must be sheared for the plywood to slide.

Another advantage is that plywood panels should not be butt together tightly or they may buckle when they expand due to heat or humidity. A slight gap should be left between panels. This invention provides a slight gap between each plywood panel that the invention is installed upon.

Still another advantage is that with the roof sheathing firmly attached to the rafters, roofing material will have a better chance of staying on during strong winds and earth movements. In addition, with the sheathing firmly connected, new materials may be attached to the roof, such as solar electric panels, without fear of them being blown off.

In areas with brush or forest fire danger, fire-proof material or heavy material, such as tile, stone or metal, can be applied to the roof with less danger of being blown or shaken off during earth tremors or high winds.

When the invention is applied to the studs and wall sheathing, fire-proof materials such as stucco or brick veneer can be applied to the sheathing with less chance of being shaken off during earth movements.

When the invention is applied to the floor joists and floor sheathing, the interior load-bearing walls can have a horizontal shear wall, inside the house, to help transfer earth movements.

Earth tremors and hurricanes always destroy the weakest parts of a house. By making each envelope of a house, the vertical walls, horizontal floors, and roof envelope into a strong unit, there will be less damage.

Another advantage is that the building contractor or a building inspector can visually inspect the roof sheathing, wall sheathing, and flooring for correct tie down, and can be assured that all the nails have been correctly placed. Previously, a visual inspection could not determine if the sheathing or flooring was properly applied and secured.

Still another advantage is that the invention can hold down standard-size or odd-size sheathing. According to Fine Homebuilding, October/November, 1998, sheathing courses should begin either with a full or half sheet. The course at the top row and beginning row are often odd-size, so that a reasonable width of sheathing is on the top row.

An advantage is that the framer can more accurately determine where the underlying structural member is located because the tie is on top of the sheathing, in line with the member.

Another advantage is the invention is, easily used with current framing methods. The invention is installed from the top side of the sheathing so the framer doesn't have to go under the sheathing, which can be dangerous.

Nailguns can be used to attach this invention if the nail protrudes from the gun, prior to being driven. Nailguns can be used to apply nails to the sheathing and underlying rafter in-between the installed inventions, just like conventional construction. Screw guns can be used as well.

Still another advantage of this invention is when it is applied to the floor joist and floor sheathing, it will keep each sheet of sheathing a slight distance from each other helping prevent squeaks. Also, after a house is built, the wood floor joists and plywood shrink at different rates, causing gaps between them. By being tightly secured with my invention, any gaps will be insignificant, averting any squeaks.

Still another object is that the invention is thin so that a covering or underlayment can be easily applied. There is no "ripping" effect where sharp corners or bends can cause stress points on the waterproof overlay. All bends and edges are smooth.

It is a further object of this invention that it easily, quickly, and economically protects houses from the destructive forces of earthquakes and hurricanes. It is a still further object that the connectors and fasteners are strong, attractive, permanent, functional, uncomplicated, simple to manufacture, easy to install, and economical. All of the embodiments can be made from a single sheet metal blank, without any welding.

A further object is that this invention can be used on various size sheathing, rafters, roof trusses, studs, wood or metal I-beams, TJI, and glue-lams, all made from wood or metal. There may be hurricane, earthquake, fire, and other insurance discounts for homeowners who have this invention installed on their houses.

Previously, architects, engineers, and builders did not know how important the attachment of plywood sheathing was to the roof, walls, and floors. It was thought that the weight of the roof would keep the sheathing attached during a storm. Prior to this invention, no thought had been given to the floor as a horizontal shear wall during an earthquake.

These and other objectives of the invention are achieved by simple and economical connectors that allow a builder to quickly and easily secure the weakest parts of a building against earth tremors and high winds.

Advantages of each will be discussed in the description. Further objects and advantages of my invention will become apparent from a consideration of the drawings and ensuing description.

REFERENCE NUMERALS

Figure 1:
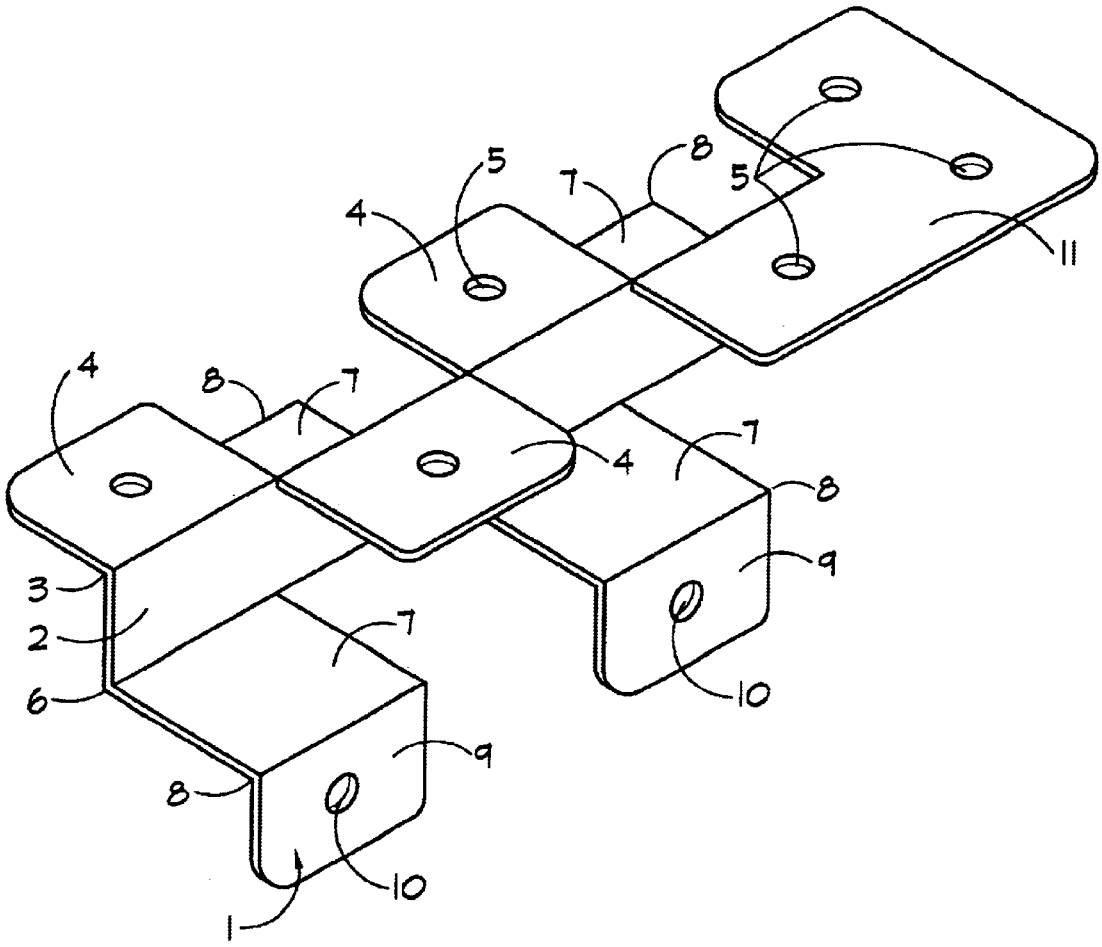
FIG. 1 Shows a perspective view of a multiple tie.

1. Multiple tie
2. Rib
3. Sheathing bend
4. Sheathing tabs
5. Nail holes
6. Rafter bend
7. Rafter web
8. Edge bend
9. Rafter tabs
10. Nail holes
11. Extension
12. Cut lines
13. Nail holes
14. Sill tab
15. Sill tie
16. Stud tie
17. Stud rib
18. Left gusset
19. Right gusset
20. Face
21. Sheathing tab
22. Left brace
23. Right brace
24. Base
25. Cut line
26. Gusset bend
27. Face bend
28. Sheathing bend
29. Left face bend
30. Right face bend
31. Nail holes
32. Nail holes
33. Nail holes
P. Sill plate
R. Rafter
S. Sheathing
W. Wall stud

DESCRIPTION

FIG. 1 shows a perspective view of a multiple tie 1 that can hold down three sheets of sheathing, and can tie two sheets of sheathing to a wall stud and sill plate. FIG. 1 shows a right-hand multiple tie 1 with the extension 11 on the right side. A left-hand multiple tie would be a mirror image with the extension on the left.

Sheathing is usually applied in a staggered pattern, like large, thin bricks, so the vertical edges are not in line. The multiple tie 1 can be installed along the thin edge of a rafter or wall stud. The rafter webs 7 would lie flush against almost half of this thin edge of the structural member.

A right angle bend, known as the edge bend 8, at the end of the rafter webs 7, forms the rafter tabs 9 bent down. The rafter tabs 9 would lie flush on the adjacent or wide side of the rafter or wall stud, and can be fastened to the member by fasteners through nail holes 10. Any uplift force on the attached sheathing would have to shear these fasteners.

At the other end of the rafter webs 7, a right angle bend, known as the rafter bend 6, forms the rib 2. The rafter webs 7 are formed alternately to the left and right from the rib 2 by rafter bends 6 bending left or right. The rib 2 is continuous for most of the multiple tie 1 until the horizontal extension 11.

The upper part of the extension 11 can cover an intersecting horizontal edge of a sheet of sheathing, so the rib 2 cannot extend into it. The rib 2 would be contiguous to adjacent, generally vertical sheets of sheathing, and space them apart. The height of the rib 2 is generally equal to the thickness of the sheathing to be installed. When the multiple tie 1 is installed to a structural member, the rib 2 is generally on the centerline of the member, midway between the outer edges.

At the top of the rib 2 a right angle bend, known as the sheathing bend 3, forms sheathing tabs 4. The sheathing tabs 4 are bent alternately to the left and right, generally opposite the parallel rafter webs 7.

The extension 11, at one end of the rib 2 is an elongated sheathing tab, and covers two sheets of sheathing. Although the extension 11 is on the right side of the rib 2 in this figure, it could be on the bottom and left side. The extension 11 and sheathing tabs 4 can have sheathing placed underneath, and secured to the rafter or wall stud with fasteners through the nail holes 5.

From the top of the multiple tie 1, fasteners are driven through the nail holes 5, on the sheathing tabs 4 and extension 11, through the sheathing, and into the structural member.

Figure 2:
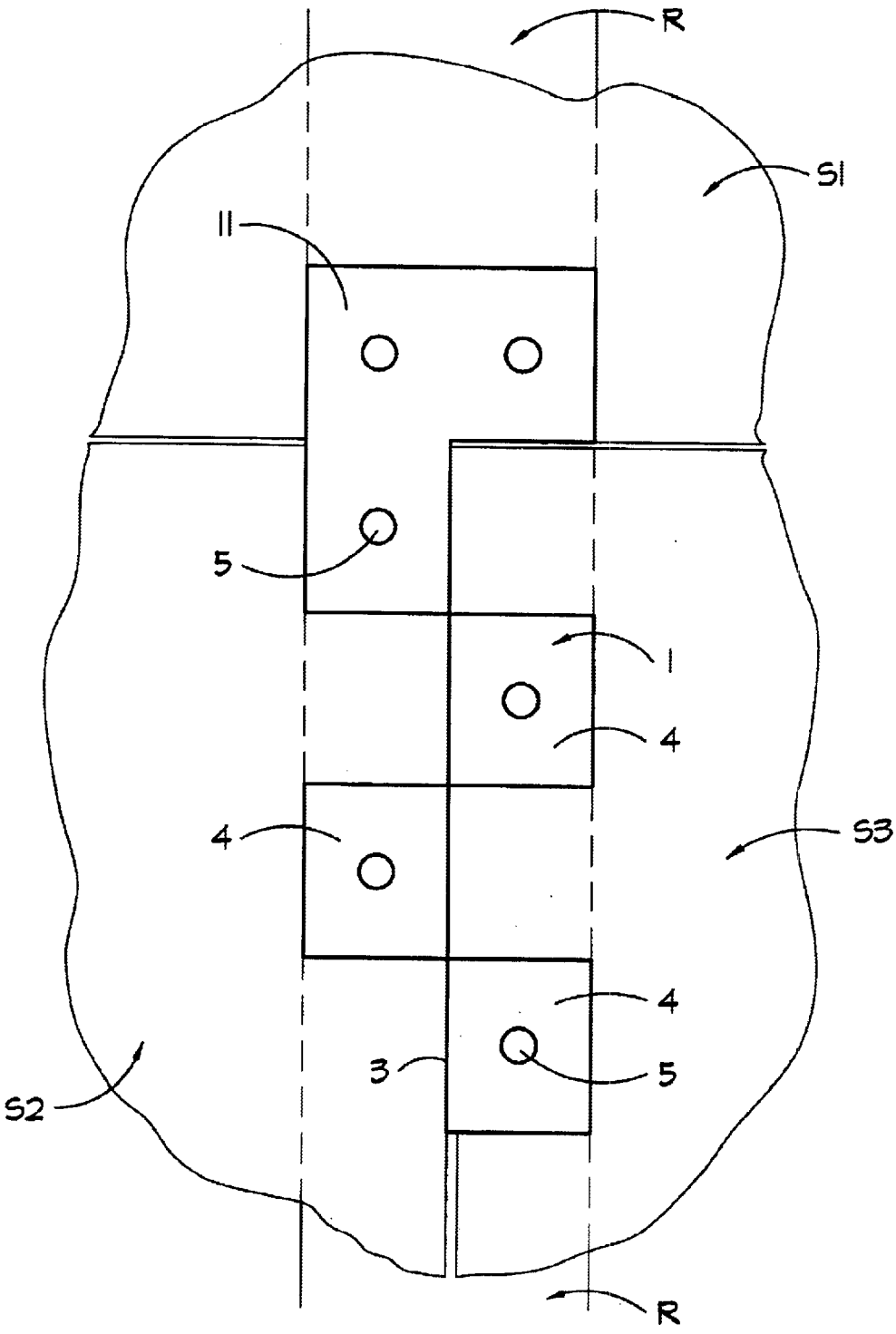
FIG. 2 Shows a top view of a multiple tie holding down three sheets of sheathing to a rafter.

FIG. 2 shows an aerial view of a multiple tie 1 holding down three sheets of sheathing S. FIG. 2 shows a left-hand multiple tie 1 with the extension 11 on the left side. On the lower part of the drawing, the vertical edges of two sheets of sheathing butt up against each other over the centerline of the rafter R.

The left sheet of sheathing S2 has a vertical edge on the rafter R and a horizontal edge under the extension 11 of the multiple tie 1. The right sheet of sheathing S3 has a vertical edge on the rafter R and a horizontal edge parallel to the left sheet S2.

The right vertical edge of the left sheet of sheathing S2 is under the lower left part of the extension 11 and under the left sheathing tab 4. Fasteners through the nail holes 5 fasten the multiple tie 1 to the sheathing S2 and the underlying rafter R.

The left vertical edge of the right sheet of sheathing S3 is under the two right sheathing tabs 4. Fasteners through the nail holes 5 fasten the multiple tie 1 to the sheathing S3 and to the underlying rafter R.

A third sheet of sheathing S1, that has vertical edges on other rafters, is held down to the rafter R with fasteners driven into nail holes 5 through the extension 11 of the multiple tie 1. The multiple tie 1 is now securing three sheets of sheathing (S1, S2, and S3) to a structural member R.

The multiple tie 1 can be installed several ways. If the upper sheet of sheathing S1 is installed first, the extension 11 can be placed over the sheet and the rafter tabs 9 can be placed over the underlying rafter R and fastened with fasteners through nail holes 10. That will secure the multiple tie 1 to the structural member. The upper sheet of sheathing S1 can be fastened with fasteners through nail holes 5 on the extension 11. The lower sheets of sheathing S2 and S3 can be placed under the sheathing tabs 4 and secured to the rafter R with fasteners through nail holes 5.

If one of the lower sheets of sheathing are to be installed first, such as the left sheet S2, the multiple tie 1 can be placed on the rafter R and the right edge of the left sheet S2 placed under the sheathing tabs 4 and on the rafter R. The multiple tie 1 can be slid along the rafter until the rib 2, under the extension 11, is even with the horizontal edge of the left sheathing S2. The rafter tabs 9 can be fastened to the rafter R, and the other sheets of sheathing S3 and S1 can be installed and fastened to the multiple tie 1 and rafter R.

In this drawing, the multiple tie 1 is holding down roof sheathing to a rafter, but the tie can be used on a wall where the rafter is a wall stud and the sheathing is wall sheathing.

Figure 3:
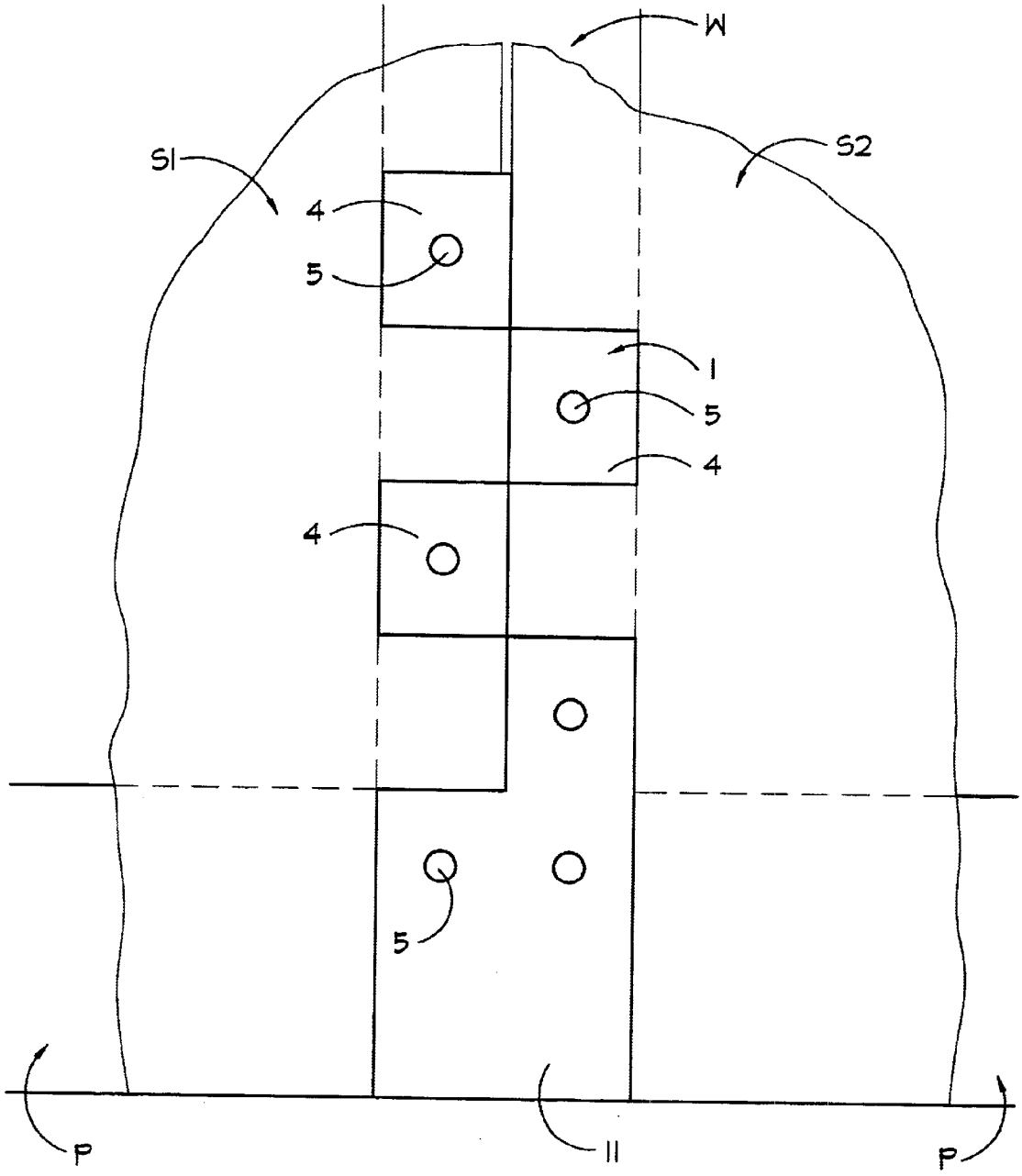
FIG. 3 Shows a front view of a multiple tie holding down two sheets of sheathing to a wall stud and sill plate.

Refer now to FIG. 3 which shows a front view of a multiple tie 1 holding down two sheets of wall sheathing to a wall stud and sill plate.

The multiple tie 1 can be fastened to the lower part of a wall, where the vertical wall stud meets the horizontal sill plate. There are usually just one or two nails holding the wall stud to the sill plate. Nails can be driven in from the bottom, when building the wall on the ground and lifting it up, or nails can be toenailed when built in place. Toenailing has been proven to be a weak connection when subjected to uplift or lateral movements. Nails from the bottom of the sill plate can be bent when subjected to wind or seismic forces.

The multiple tie 1 holds multiple sheets of sheathing to an underlying structural member. The multiple tie 1 ties the vertical edges of two adjacent sheets of sheathing together and to the underlying wall stud and sill plate.

In FIG. 3, the vertical wall stud W has been previously attached to the horizontal sill plate P. A multiple tie 1 is placed on the wall stud W so the extension 11 is even with the sill plate P. The multiple tie 1 is attached to the wall stud W with fasteners through nail holes 10 on the rafter tabs 9.

One sheet of sheathing S1 can be slid in from the left and placed under the sheathing tabs 4 and left part of the extension 11. The right sheathing sheet S2 can be slid in from the right and placed under the rafter tabs 4 and right part of the extension 11. Fasteners through the nail holes 5 on the rafter tabs 4 and extension 11 will secure both sheets of sheathing S1 and S2 to the wall stud W and sill plate P.

Any lateral or movement to the left and right, such as occurs during an earthquake, will be prevented as the corners of the sheathing are secured together and to the underlying structural members. The corners of the sheathing are prevented from detaching from the structural members, prevented from riding over each other, and prevented from splitting and splintering.

With the sheathing securely fastened to the structural members, the wall can truly be called a shear-wall, able to resist uplifting,forces from strong winds, able to resist lateral movements from seismic events, and able to resist thrusting from strong winds and snow loads on the roof.

Figure 4:
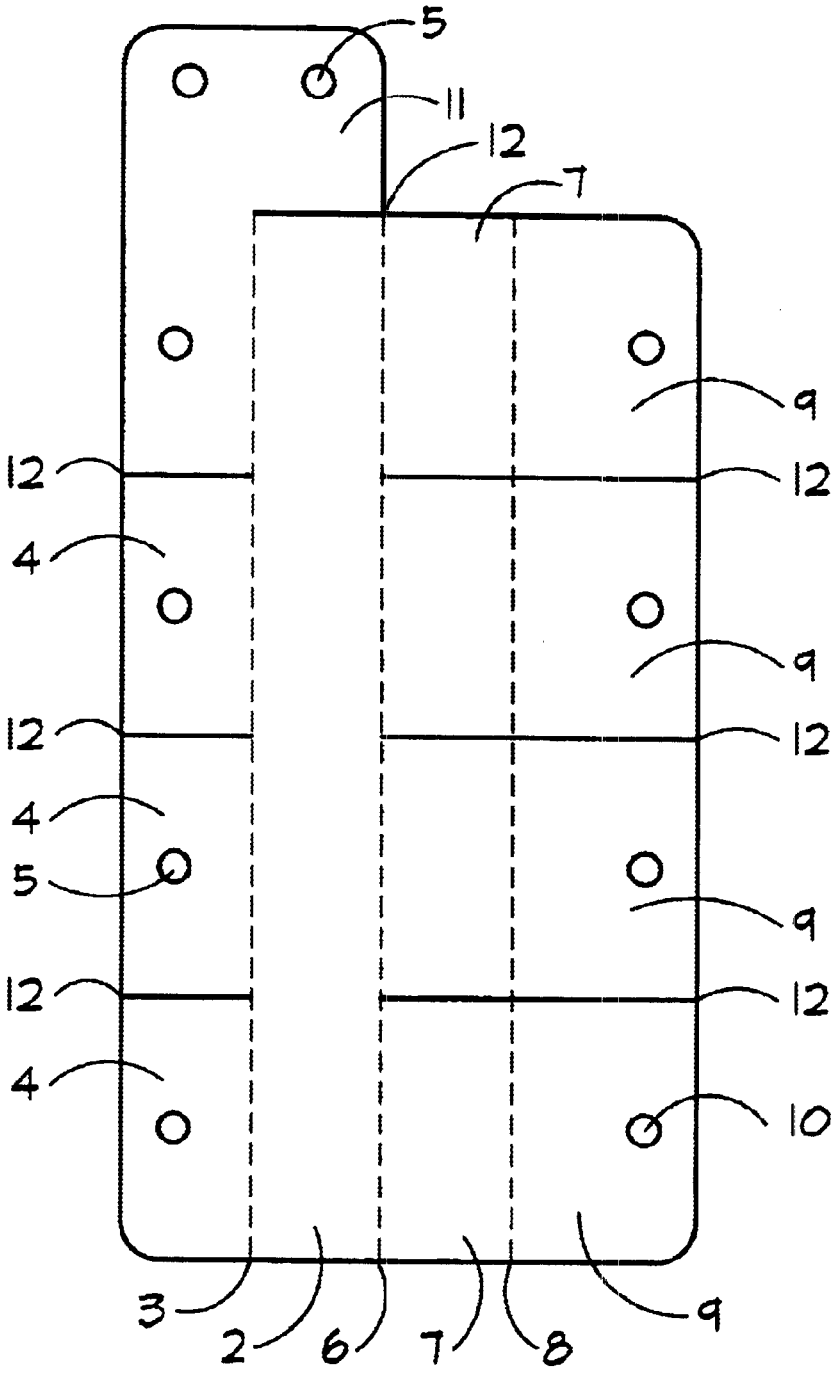
FIG. 4 Shows a flat pattern layout of a multiple tie.

Refer now to FIG. 4 which shows a flat pattern layout of a left-hand multiple tie 1, prior to cutting and bending. The cut lines 12 are solid lines and the bend lines 3, 6, and 8 are dashed lines. There would be little waste of material during manufacture.

The rafter tabs 4 and the extension 11 are on the left side of the rib 2, next to the sheathing bend 3. The rib 2 extends for most of the length of the multiple tie 1. Attached to the right side of the rib 2 are the rafter bend 6, rafter webs 7, edge bend 8, and rafter webs 9. On a right-hand multiple tie 1, the pattern would be a mirror-image.

After the cuts and bending are done by tool and die methods, the multiple tie 1 can be used. The width of the rib 2 can be changed to fit various thickness of sheathing, as specified by local building codes. The rafter tabs 4 and rafter webs 7 can be changed to fit various thickness of structural members, although most are 2 by's, which are 1½ inches thick.

The multiple tie 1 can be used on the outside of a house to secure sheathing or insulating panels, or on the inside of a house to secure gypsum boards or insulating panels. The multiple tie 1 can be used on roofs where electrical panels or solar panels will be installed so they will be properly secured and won't be shaken or blown off by seismic events or strong winds.

Figure 5:
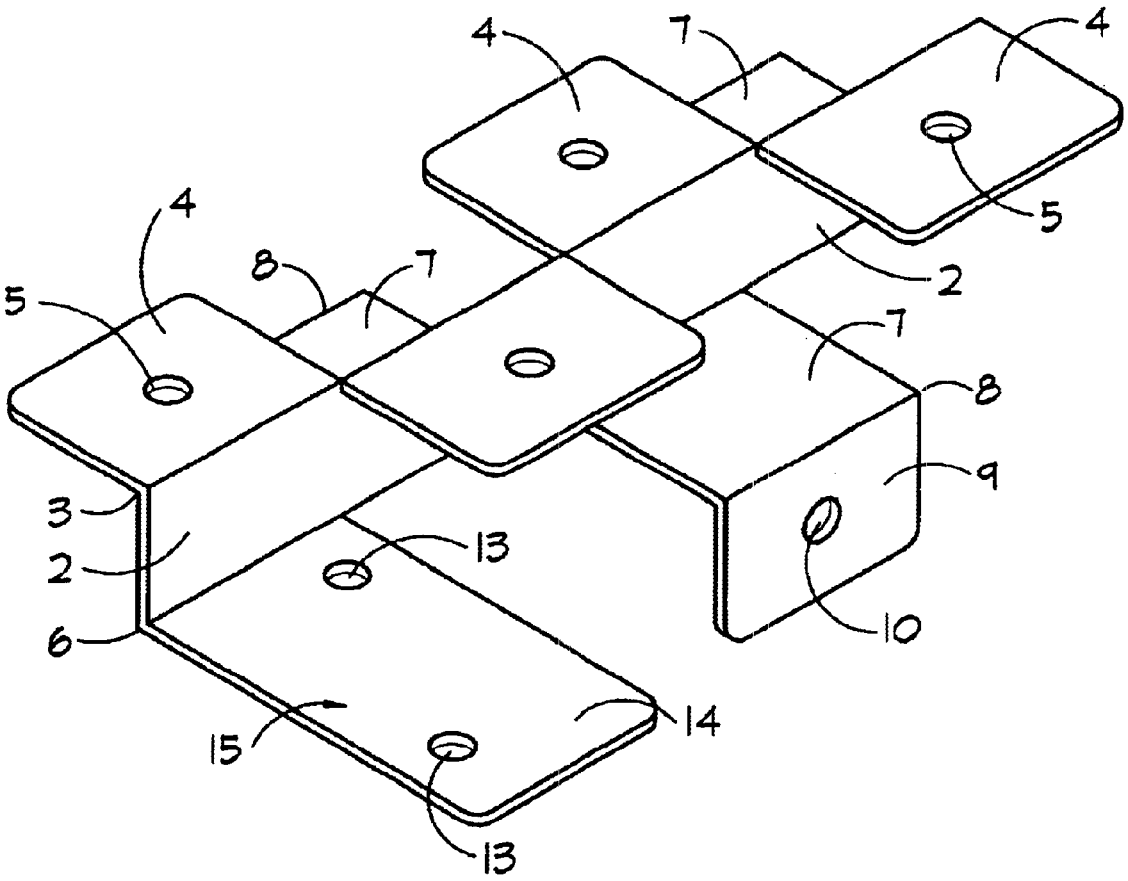
FIG. 5 Shows a perspective view of a sill tie.

Refer now to FIG. 5 which shows a perspective view of a sill tie 15. The sill tie 15 is similar to the multiple tie 1. Whereas the multiple tie 1 had a sheathing tab extended to form an extension 11, the sill tie 15 has a rafter tab extended to form a sill tab 14. The sill tie 15 can tie down two sheets of sheathing to a wall stud and sill plate.

The upper part of the sill tie 15 has a rib 2 that runs the length of the tie. Attached to the top of the rib 2 is the right angle sheathing bend 3 that forms sheathing tabs 4, that are bent alternately left and right.

The lower part of the rib 2 has the right angle rafter bend 6 that forms rafter webs 7, that are bent alternately left and right. Attached to the end of the rafter webs 7 are right angle edge bends 8, that form rafter tabs 9 bent down.

The lowest rafter web 7 is not bent at the edge bend 8. Instead, the tab is extended straight out at the rafter bend 6, forming a sill tab 14.

The sill tie 15 can be fastened to the lower part of a wall, where the vertical wall stud meets the horizontal sill plate. There are usually just one or two nails holding the wall stud to the sill plate. Nails can be driven in from the bottom, when building the wall on the ground and lifting it up, or nails can be toenailed when built in place. Toenailing has been proven to be a weak connection when subjected to uplift or lateral movements. Nails from the bottom of the sill plate can be bent when subjected to wind or seismic forces.

Like the multiple tie 1, the sill tie 15 holds multiple sheets of sheathing to an underlying structural member. The sill tie 15 ties the vertical edges of two adjacent sheets of sheathing together and to the underlying wall stud and sill plate.

A sill plate is usually bolted to the foundation through the wide side of the sill plate, so the thin edge of the sill plate faces to the outside. The wall studs are placed so the thin edge of the wall stud is vertical, perpendicular, and abutting to the thin edge of the horizontal sill plate.

Figure 6:
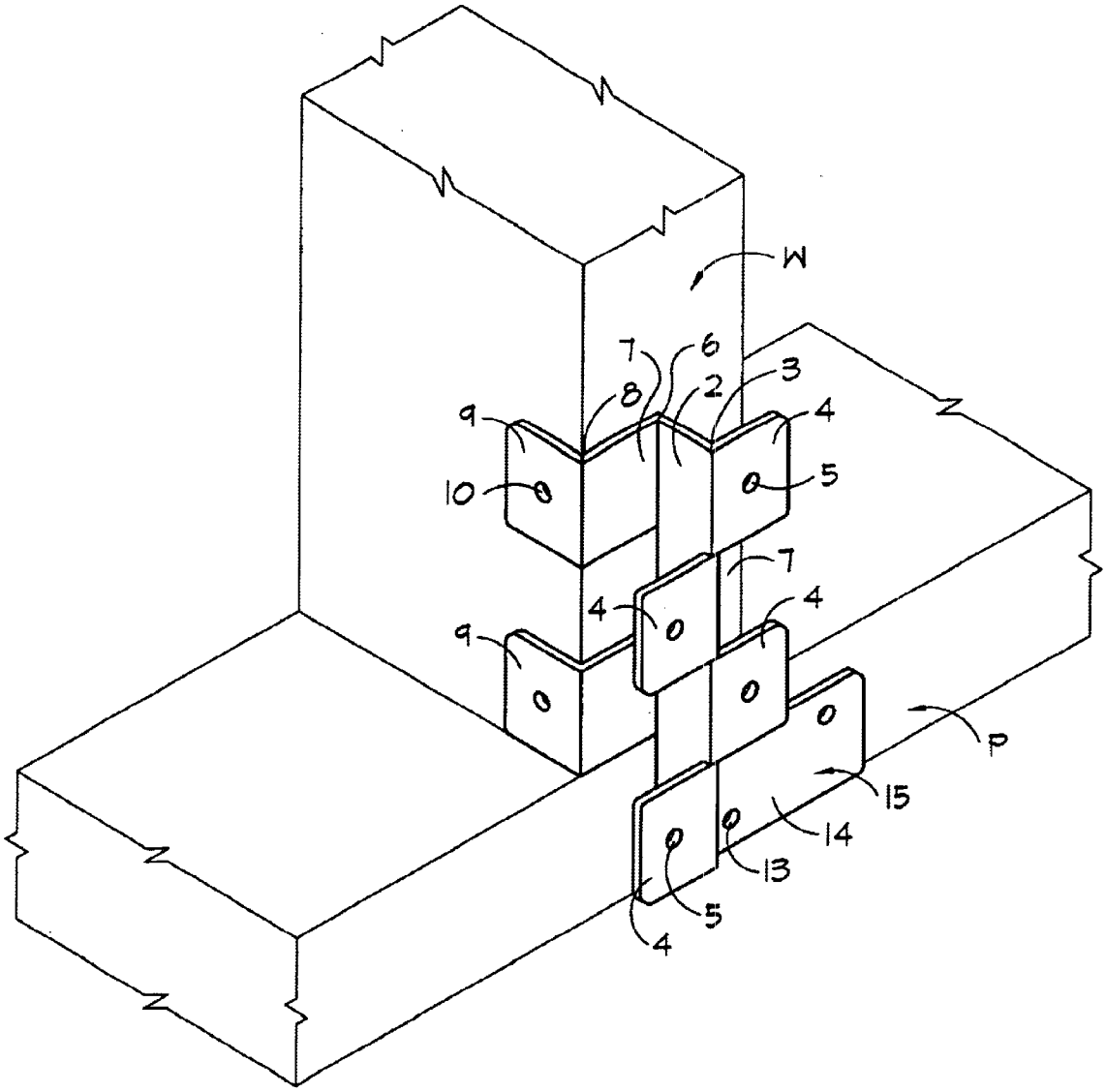
FIG. 6 Shows a perspective view of a sill tie installed on a stud and sill plate.

Refer now to FIG. 6 which shows a perspective view of a sill tie 15 attached to a wall stud W and sill plate P. Installation and use of the sill tie 15 is simple. Sheets of wall sheathing are usually placed vertically on a wall. If the wall studs are 16-inches-on-center, the four-foot wide sheet will cover four wall studs. On the fourth stud, the sheet will have it's vertical edge along the centerline of the stud. The sill tie 15 can be installed on every fourth stud before the sheathing is installed. Sheathing is usually installed immediately because the wall can rack, go out of square, or even fall down. The sill tie 15 helps prevent racking because the wall stud and sill plate are securely fastened.

The sill tie 15 is placed against the wall stud so the rafter tabs 9 are on the wide side of the wall stud, the rafter webs 7 are on the thin side of the wall stud, and then slid down until the sill tab 14 is against the thin side of the sill plate.

The sill tab 14 can be fastened to the sill plate with fasteners through the nail holes 13 on the sill tab 14. The rafter tabs 9 can be fastened to the wall stud with fasteners through nail holes 10 on the rafter tabs 9. The wall stud is now securely fastened to the sill plate. Lateral and uplift motions would have to shear the fasteners in the wall stud and sill plate.

Figure 7:
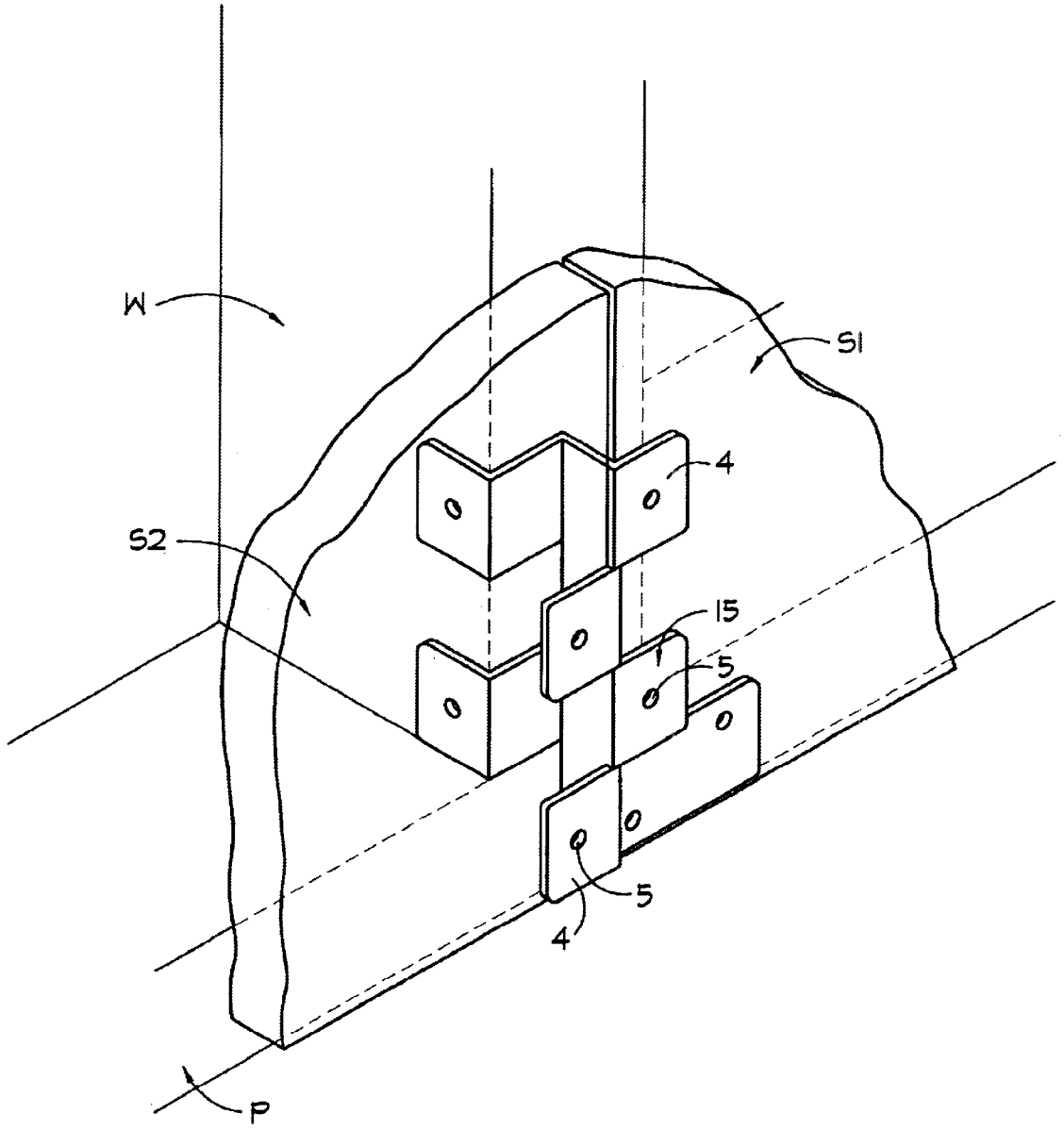
FIG. 7 Shows a perspective view of a sill tie holding down two sheets of sheathing to a wall stud and sill plate.

Refer now to FIG. 7 which shows a perspective view of a sill tie 15 holding down two sheets of sheathing. After the sill tie 15 is installed on the wall stud W and sill plate P, the vertical edges of wall sheathing can then be inserted under the sheathing tabs 4, against the rafter webs 7, and against either side of the rib 2.

The sheathing can be secured to the sill tie 15 and wall stud by fasteners through the nail holes 5 of the sheathing tabs 4. The important lower corners of the sheathing are now securely fastened to the structural members. Standard fasteners can be used to tie the field of the sheathing to the wall studs.

Figure 8:
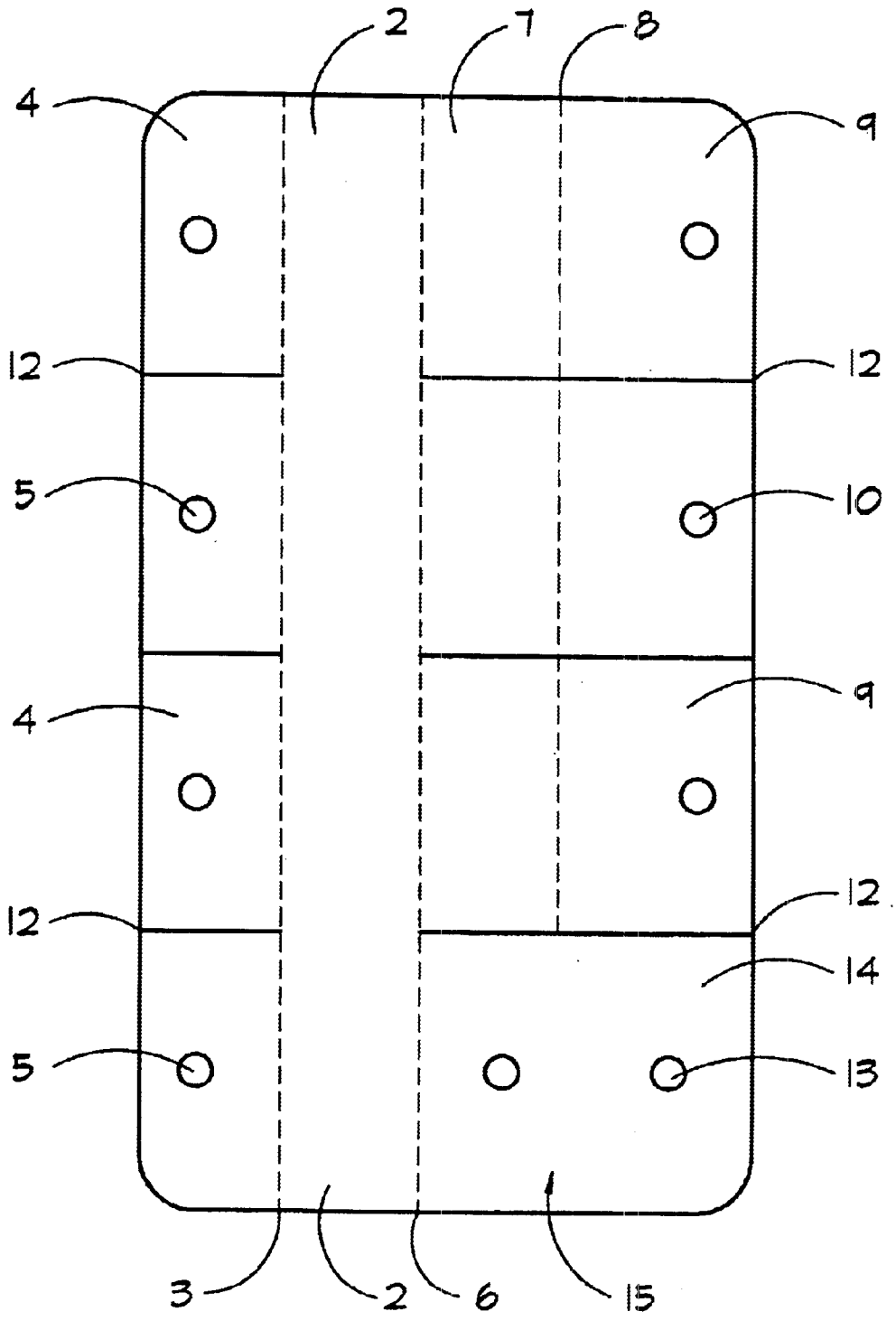
FIG. 8 Shows a flat pattern layout of a sill tie.

Refer now to FIG. 8 which shows a flat pattern layout of a sill tie 15. The cut lines 12 are solid lines and the bend lines 3, 6, and 8 are dashed lines. The rafter tabs 4 are on the left side, connected to the rib 2. The rafter webs 7 and rafter tabs 9 are on the right side. The sill tab 14 does not have an edge bend 8. This is a right-hand sill tie 15, where the sill tab 14 is on the right side of the rib 2. A left-hand sill tie 15 would have the sill tab 14 on the top of the flat pattern layout.

Figure 9:
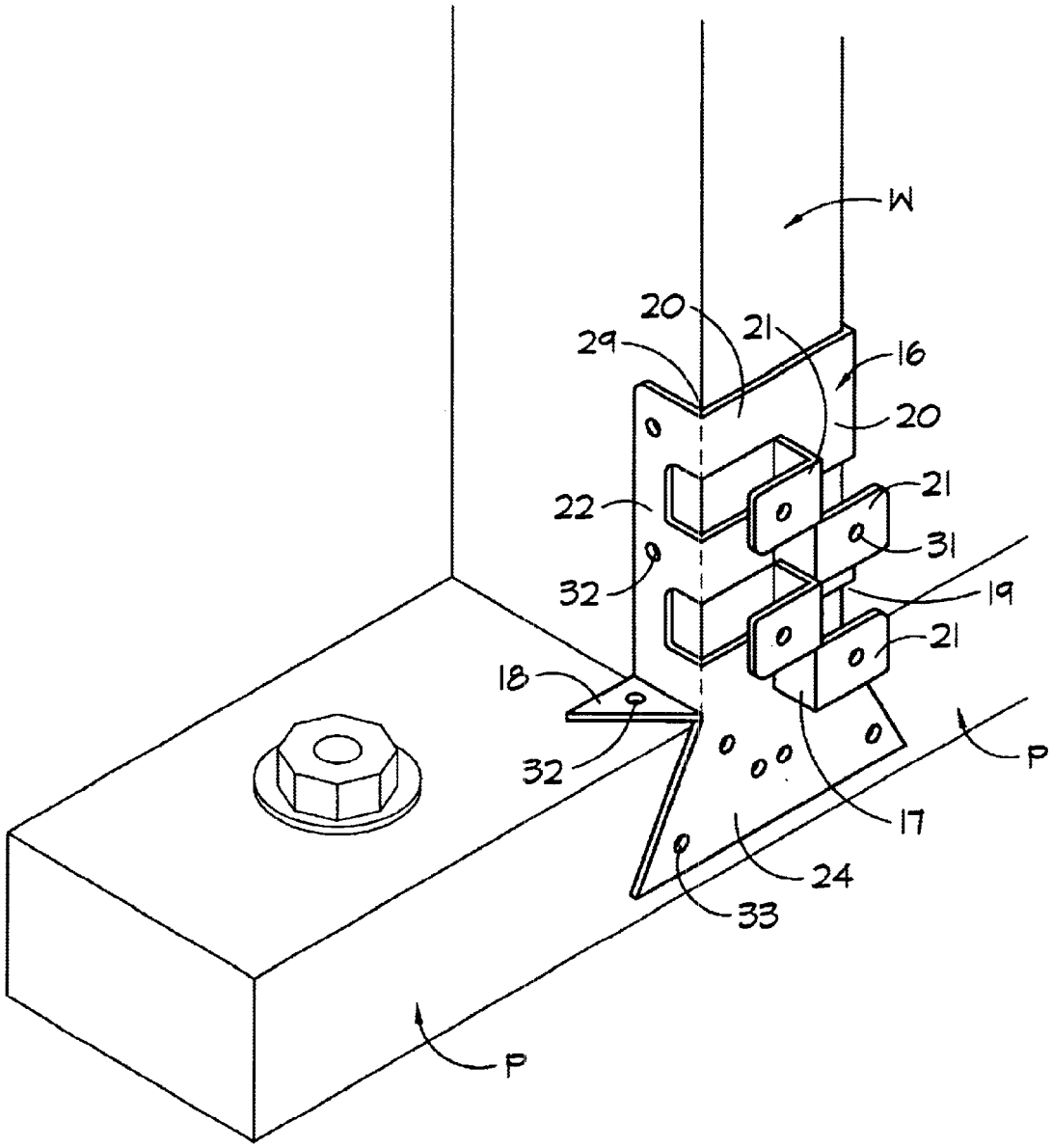
FIG. 9 Shows a perspective view of a stud tie installed on a wall stud and sill plate.

Refer now to FIG. 9 which shows a perspective view of a stud tie 16 mounted on a wall stud and sill plate. The stud tie 16 is similar to the sill tie 15 except the stud tie 16 has gussets 18 and 19 mounted to the top of the sill plate.

The stud tie 16 has a rectangular face 20 that mounts to the thin side of a wall stud W. A right-angle left face bend 29, on the left side of the face 20, forms a left brace 22. A right-angle right face bend 30, on the right side of the face 20, forms a right brace 23. The left brace 22 and right brace 23 wrap on the wide, opposite sides of a wall stud W.

On the upper part of the face 20, right angle face bends 27 form stud ribs 17 that are parallel and planer to each other. Right angle sheathing bends 28 bend the sheathing tabs 21 alternately left and right.

The lower part of the face 20 has a trapezoid-shaped base 24, which can be mounted to the thin edge of a sill plate P. A right angle gusset bend 26 forms a left gusset 18 off the bottom of the left brace 22. A right angle gusset bend 26 forms a right gusset 19 off the bottom of the right brace 23. The gussets 18 and 19 are mounted to the wide, top part of the sill plate P.

The wide, trapezoid-shaped base 24 is attached to the sill plate P with fasteners through nail holes 33. This attachment helps prevent uplift and lateral movement between the wall stud W and sill plate P because the fasteners would have to be sheared. The gusset's 18 and 19 attachment to the wide, top part of the sill plate P with fasteners through nail holes 32 add extra support against racking, uplift, and thrusting.

Fasteners attached through the nail holes 32 on the left brace 23 and right brace 23 into the wide, opposite sides of the wall stud W add tremendous strength to the stud tie 16.

The stud ribs 17 form a parallel line, so when sheathing is inserted from the left or right the sheathing will be spaced apart from each other correctly. The sheathing is inserted under the sheathing tabs 21 on the left and right and fasteners are driven through the nail holes 31 into the sheathing and into the underlying wall stud W.

The stud tie 16 is installed as shown in FIG. 9, where the vertical edges of two adjacent sheets of sheathing will abut over the centerline of a wall stud W. The left brace 22 and right brace 23 are placed around the wall stud W and slid down until the gussets 18 and 19 are on the wide, top part of the sill plate P. The base 24 will cover the thin, side part of the sill plate P. Fasteners through the numerous nail holes 32 and 33 will secure the stud tie 16 to the structural members. Sheathing inserted from the sides under the sheathing tabs 21 can be secured with fasteners through nail holes 31. the gussets 18 and 19 are attached to the wide, bottom of the top plate. The base 24 can be extended up to cover and be attached to the sides of a double top plate.

Just as the multiple tie 1 can be used where multiple sheathing edges meet on a wall stud or rafter, the sill tie 15 can be used on the top of a wall stud W. By turning FIG. 6 upside-down, the sill tab 14 can be attached to a single top plate. By extending the sill tab 14 upward, it can cover and be attached to the sides of a double top plate.

With the top and bottom corners of the wall sheathing positively secured to the top plate, wall stud, and sill plate, the wall can transfer forces to the foundation. The secure attachment of the sheathing corners helps turn the wall into a shear-wall, able to resist forces from several directions.

Figure 10:
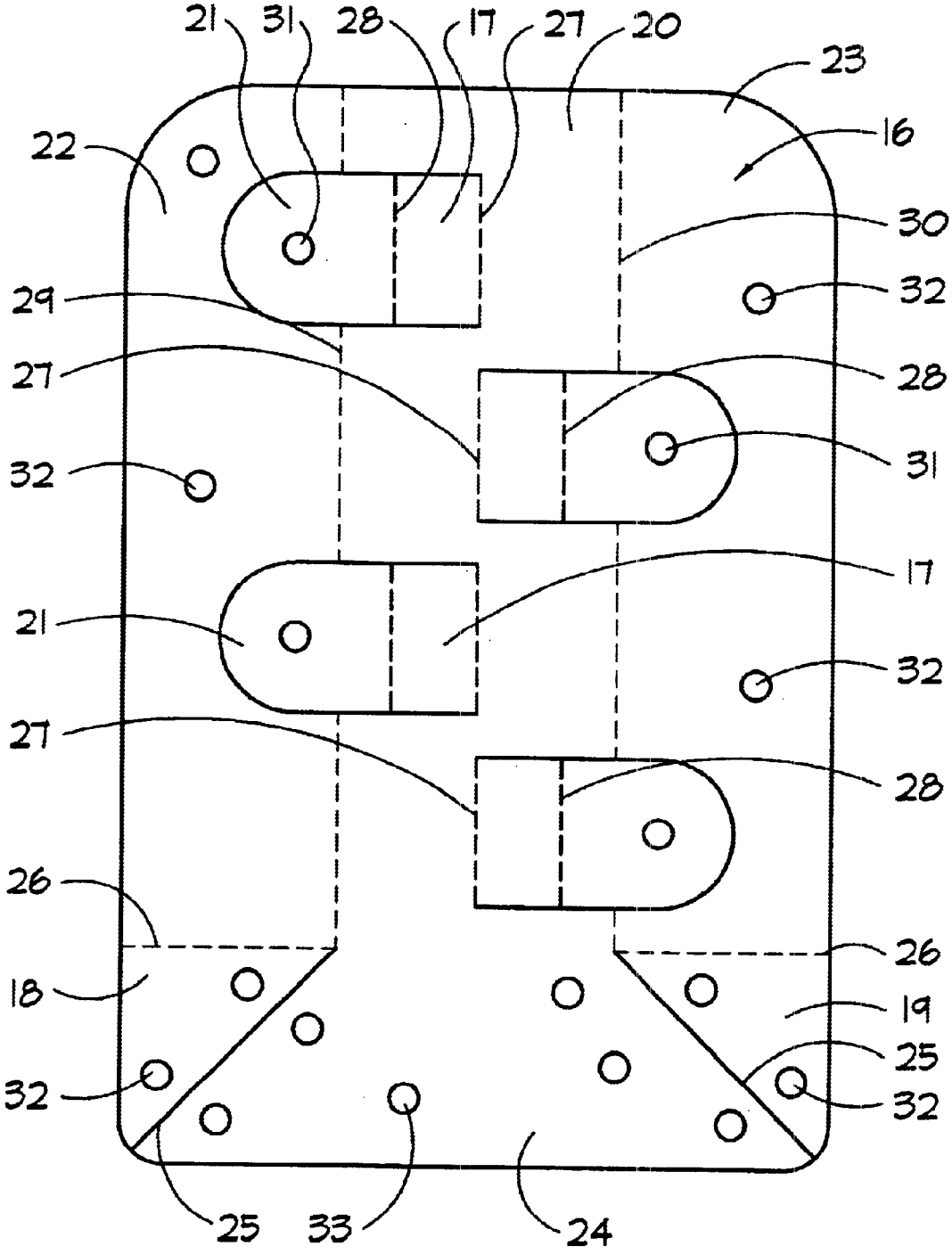
FIG. 10 Shows a flat pattern layout of a stud tie.

Refer now to FIG. 10 which shows a flat pattern layout of a stud tie 16. The solid lines are cut lines 25 and the dashed lines 26, 27, 28, 29, and 30 are bend lines. This shows the right brace 23 and right gusset 19 that were hidden from view on FIG. 9 by the wall stud.

CONCLUSION, RAMIFICATIONS, AND SCOPE

Thus, the reader will see that the sheathing tie of the invention provides a simple and economical connector that allows a builder to quickly, easily, and accurately secure weak parts of a building against earth tremors and high winds.

While my above description contains many specificities, these should not be construed as limitations on the scope of the invention, but rather as an exemplification of one preferred embodiment thereof. Many other variations are possible.

There can be minor variations in size, and materials. For example, the ties can have more rounded corners or squarer corners as shown in FIGS. 9 and 10, wavy lines instead of straight lines, more nail holes, slightly less nail holes, or be thicker or thinner, wider or longer. The ties can be made for 2×4's and ¾ inch sheathing, or 2×6's with ⅝ inch sheathing or many other combinations of sheathing or beam size, including metric sizes.

The ties can hold down boards instead of sheathing; they can also hold down insulated sheets or metal sheets. The ties can have a variety of shapes stamped in the sheathing tabs (4, and 21) to hold down a variety of objects against sheathing.

The ties can have tongues and groves stamped into the ribs 1 for use on sheathing that has tongue and groove edges. The ties can have round webs and tabs to fit around circular beams.

In instances where the rafters are warped, twisted, or bowed, the ties can help straighten them by securing the sheathing tightly with screws. On rough or un-planed boards, timbers, or beams, the ties, by wrapping around three edges of the timbers, form a secure connection to the sheathing.

The ties can be attached to different types of structural beams including wood, plastic, metal, concrete, or lightweight composite materials. The ties can hold down different types of sheathing including wood, glass, plastic, metal, concrete, slate, and mane-made materials.

The ties can be stamped as mirror images of the flat pattern layouts, for example, creating a tie with the sheathing tabs and rafter webs on reversed sides.

The ties can be made of metal by stamping, forging, or casting. The ties can be made of plastic, by molding or casting. The ties can be made of recycled materials. The ties can be made with bright colors, so a builder or inspector knows they are in position. They can be of different thicknesses, where the gap between each sheet has to be a specific distance.

Accordingly, the scope of the invention should be determined not by the embodiments illustrated, but by the appended claims and their legal equivalents.

I claim:

1. A unitary apparatus for securing sheathing to structural members of a building comprising:

a. a unitary body having a face, a rib, generally right angle bends, sheathing tabs, braces, and gussets;

b. said face having right angled bends forming a generally perpendicular rib;

c. said rib having right angled bends forming generally perpendicular sheathing tabs;

d. said face having right angled bends forming generally perpendicular braces;

e. said braces having right angle bends forming generally perpendicular gussets;

f. said face having a planar extension forming a base.

2. The apparatus of claim 1 wherein said face is generally rectangular-shape with the long dimension in a generally vertical position.

3. The apparatus of claim 1 wherein said right angled bends, forming said rib, are generally in the middle of said rectangular face, and generally parallel to the long dimension of said rectangular face.

4. The apparatus of claim 1 wherein said right angled bends, forming said sheathing tabs, are generally bent left and right, thereby placing said sheathing tabs on the left and right sides of said rib.

5. The apparatus of claim 1 wherein said face, said rib, and said sheathing tabs forming an open-box shape for receiving sheathing on the left and right sides of said rib.

6. The apparatus of claim 1 wherein said sheathing tabs having a nail hole for attachment to said sheathing and to a structural member underlying said face.

7. The apparatus of claim 1 wherein said face having said right angled bends, forming each said brace, generally near each end of the long dimension of said rectangular face.

8. The apparatus of claim 1 wherein said braces having a generally rectangular shape and bent generally parallel to each other.

9. The apparatus of claim 1 wherein said braces having a plurality of nail holes for attachment to opposite sides of said structural member underlying said face.

10. The apparatus of claim 1 wherein each said brace having a right angle bend, generally near the bottom of said brace, forming said gussets.

11. The apparatus of claim 1 wherein each said gusset having a generally triangular shape and generally bent planar to each other.

12. The apparatus of claim 1 wherein each said gusset having a nail hole for attachment to a side of a structural member that intersects said structural member attached to said braces and underlying said face.

13. The apparatus of claim 1 wherein said planar extension forming said base is generally on the lower, short dimension of said rectangular face.

14. The apparatus of claim 1 wherein said base having a generally trapezoidal-shape and a plurality of nail holes, for attachment to an adjacent side of said structural member attached to said gussets.

15. A unitary apparatus having a generally rectangular face, a rib generally in the middle of said face, generally right angle bends, sheathing tabs on said rib, a pair of generally rectangular braces, each attached to a generally triangular gusset, and a generally trapezoidal-shaped base attached to said face.

16. The apparatus of claim 15 wherein said rectangular face and said pair of rectangular braces having right angle bends that form said face and said braces to fit on three sides of a structural member.

17. The apparatus of claim 15 wherein said rectangular face, said rib, and said sheathing ties having right angle bends that form said face, said rib, and said sheathing tabs to fit around three sides of adjacent sheets of sheathing, thereby securing said sheathing to said structural member.

18. The apparatus of claim 15 wherein said triangular gussets and said trapezoidal-shaped base having attachment to two sides and three areas of a structural member, thereby preventing detachment or lateral movement.

19. The apparatus of claim 15 wherein a face and a pair of braces surround a structural member on three sides, and said face, a rib, and a plurality of sheathing tabs surround a pair of adjacent sheathing members on three sides, and a pair of gussets and a base surround an intersecting structural member on two sides, thereby securing together two intersecting structural members and two planar sheets of sheathing, thereby preventing wind and seismic damage to a building.

* * * * *